United States Patent [19]

Patterson

[11] 3,954,550

[45] May 4, 1976

[54] TAPE APPLYING DEVICE

[75] Inventor: Richard A. Patterson, Woodbury, Minn.

[73] Assignee: Minnesota Mining and Manufacturing Company, St. Paul, Minn.

[22] Filed: Oct. 10, 1974

[21] Appl. No.: 513,596

[52] U.S. Cl. ..... 156/486; 156/522; 156/530; 93/36.9

[51] Int. Cl.[2] ..... B31B 1/60

[58] Field of Search ..... 156/522, 486, 475, 530, 156/477 R; 93/36.9; 53/137, 66

[56] References Cited

UNITED STATES PATENTS

| | | | |
|---|---|---|---|
| 2,726,783 | 12/1955 | Erickson | 156/522 |
| 2,799,419 | 7/1957 | Scheib | 156/522 |
| 3,066,723 | 12/1962 | Remington et al. | 156/522 |
| 3,079,977 | 3/1963 | Larkin | 156/486 |
| 3,406,084 | 10/1968 | Varga | 156/522 |

*Primary Examiner*—William A. Powell
*Assistant Examiner*—M. G. Wityshyn
*Attorney, Agent, or Firm*—Alexander, Sell, Steldt & DeLaHunt

[57] ABSTRACT

A device for applying lengths of adhesive coated tape from a supply length of tape to seal boxes driven along a path past the device. The device includes an application roller initially positioned in the path and supporting an end of the tape for contact by a box to adhere the tape to its leading surface. The application roller is mounted so that, subsequent to such contact, it will be revolved against the bias of a spring and will roll over tape being pulled from the device to press the tape against the surfaces of the box as the box is driven further along the path. Cam and ratchet mechanisms operated by movement of the application roller manipulate a pinch roller (1) to engage the tape closely adjacent its terminal end and hold the tape against the application roller prior to contact of the tape by a box, (2) to move around a longitudinal edge of the tape being applied and re-engage the tape on the application roller in advance of the portion of the application roller adjacent the box subsequent to engagement of a box with tape on the application roller and before a knife on the device severs the tape between the application roller and the box, and (3) to hold the tape against the application roller as the spring returns the application roller to its initial position subsequent to operation of the severing means, while the pinch roller moves along the tape on the application roller to its original position closely adjacent the newly severed end of the tape.

9 Claims, 10 Drawing Figures

TAPE APPLYING DEVICE

BACKGROUND OF THE INVENTION

1. Field of the Invention

This invention relates to devices for applying lengths of pressure sensitive adhesive coated tape to objects, and in one aspect to such devices including means for holding the end of the tape adhesive side out on an application roller prior to contact between an object and the tape end.

2. Description of the Prior Art

The art is replete with devices for applying lengths of pressure sensitive adhesive coated tape from a supply length of tape to objects driven along a predetermined path past the device. Such devices are commonly used to seal boxes filled with merchandise driven past the device by a conveyor. Typically the device includes an application member such as a roller for supporting an end of the tape, adhesive side out, in a contact position at which the tape end will be contacted by such a box. Upon contact the tape end adheres to the box and is subsequently pulled from the device and applied around the surface of the box by movement of the box, while the application member moves along the surface of the box to guide the tape being applied. The device severs the applied length of tape from the supply length and engages and moves the newly severed end of the supply length of tape to the contact position for contact by the next box on the conveyor.

Such devices have used various means for holding the tape end in a proper position on the application member for contact by a box driven along the conveyor, and for engaging and holding the newly severed tape end and during movement of the application member back to the contact position during operation of the device; including vacuum rollers, jets of high pressure air, spring fingers and static electric charges. One more efficient means is that disclosed in U.S. patent application Ser. No. 513,595, filed concurrently herewith, now U.S. Pat. No. 3,915,786, and incorporated herein by reference, which discloses a device which was invented, reduced to practice, and known to me prior to the invention of the device disclosed herein. Briefly that application discloses a device in which the aforementioned means includes means adapted for engagement with the adhesive surface of the tape and for affording relative movement between the tape and the engagement means, comprising a knurled rotatably mounted pinch roller. The pinch roller is mounted for pivotal movement about an axis generally normal to its axis of rotation and spaced from one of its ends between (1) an engage position with the axes of the pinch roller and an application roller generally parallel and the peripheral surfaces of the rollers proximate to engage opposite surfaces of the tape when positioned therebetween to hold the tape against the application roller and afford relative movement between the tape and rollers; and (2) a release position with the pinch roller pivoted out of engagement with tape on the application roller. The pinch roller is initially positioned in its engage position at one end of the tape to properly position the tape around the application roller. Means are provided for moving the pinch roller from its position at the end of the tape, to its release position and around a longitudinal edge of the tape being pulled out of the device by movement of the box and back into engagement with the supply length of tape to re-engage its newly severed end during the operational cycle of the device. The device disclosed in that application, however requires two application members with a pinch roller mounted adjacent each application member, and is thus not as simple as may be desired.

SUMMARY OF THE INVENTION

A tape applying device according to the present invention includes a novel means for mounting and manipulating means adapted for engagement with the adhesive surface of the tape, such as the aforementioned pinch roller, so that it will perform all the functions performed by the holding means in U.S. Pat. No. 3,915,786, while providing a simplified mechanical structure which requires only a single application member or roller.

According to the present invention there is provided a device of the aforementioned type for applying lengths of pressure sensitive adhesive coated tape from a supply length of tape seriatim on the peripheries of spaced objects driven along a predetermined path in a first direction past the device. The device includes engagement means such as the pinch roller adapted for engagement with the adhesive surface of said tape, and means mounting the engagement means for movement (1) from an initial position in engagement with the tape closely adjacent an end of the tape on the support member, around one longitudinal edge of the tape guided onto the support member, and back into contact with the tape thereon in advance of the portion of the support member adjacent a box as the application roller moves from its contact to its second position, and (2) from that position along the periphery of the application roller to its original position closely adjacent the newly severed end of the tape as the application member is moved back to its contact position.

BRIEF DESCRIPTION OF THE DRAWING

The present invention will be further described with reference to the accompanying drawing wherein like numbers refer to like parts in the several views, and wherein.

DESCRIPTION OF THE PREFERRED EMBODIMENT

Figure 1:
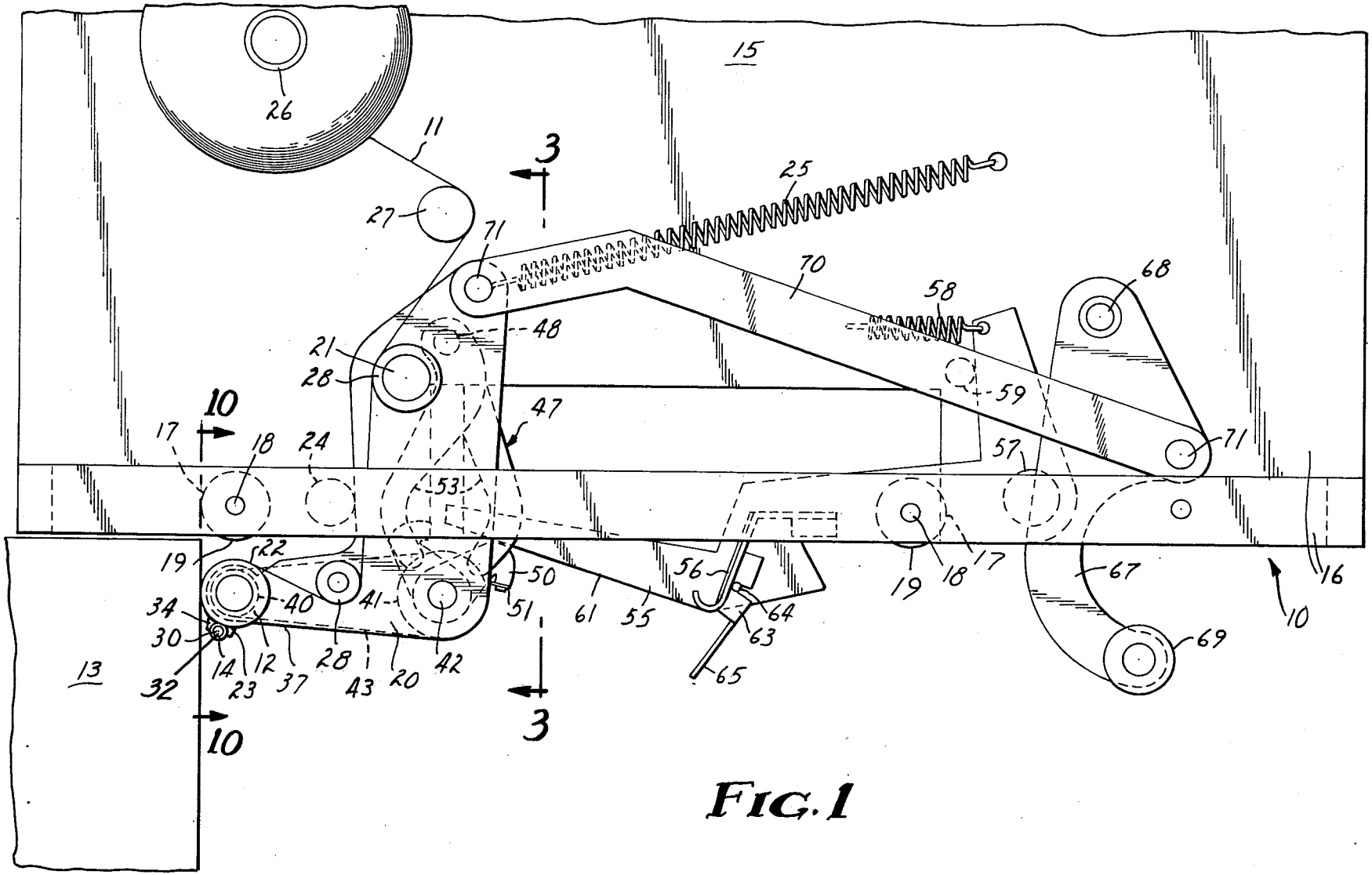
FIG. 1 is a side view of a strip applying device according to the present invention.
Figure 2:
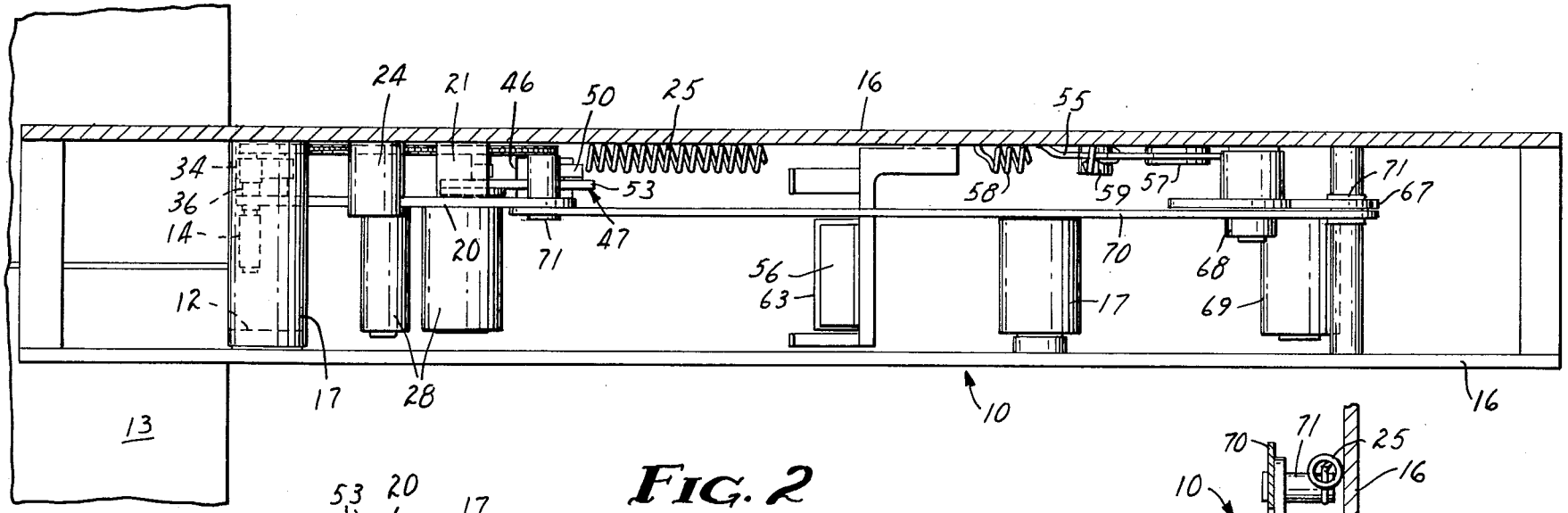
FIG. 2 is a top view of the device shown in FIG. 1.
Figure 3:
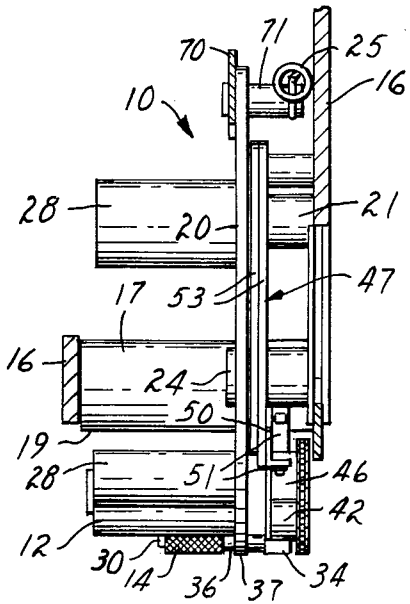
FIG. 3 is a sectional view taken approximately along lines 3—3 in FIG. 1.
Figure 10:
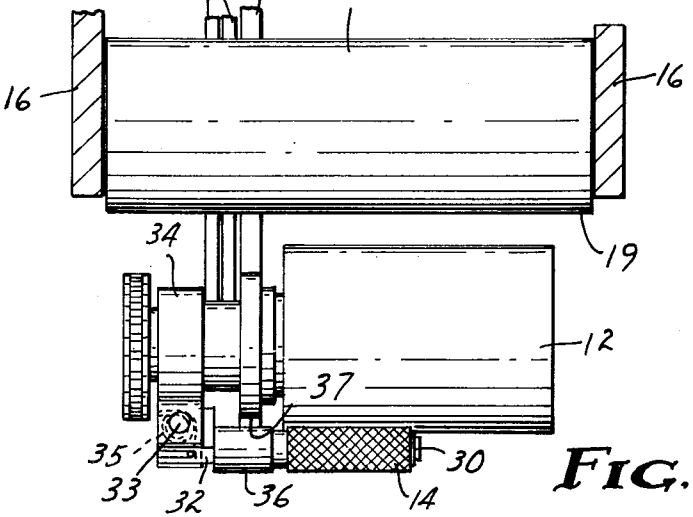
FIG. 10 is an enlarged fragmentary sectional view taken approximately along lines 10—10 of FIG. 1.

Referring now to the drawing there is illustrated a tape applying device 10 according to the present invention adapted for applying lengths of pressure sensitive adhesive coated tape from a supply length of tape 11 seriatim on the peripheries of randomly spaced rectangular objects or boxes driven along a predetermined path past the device 10.

Figure 4:
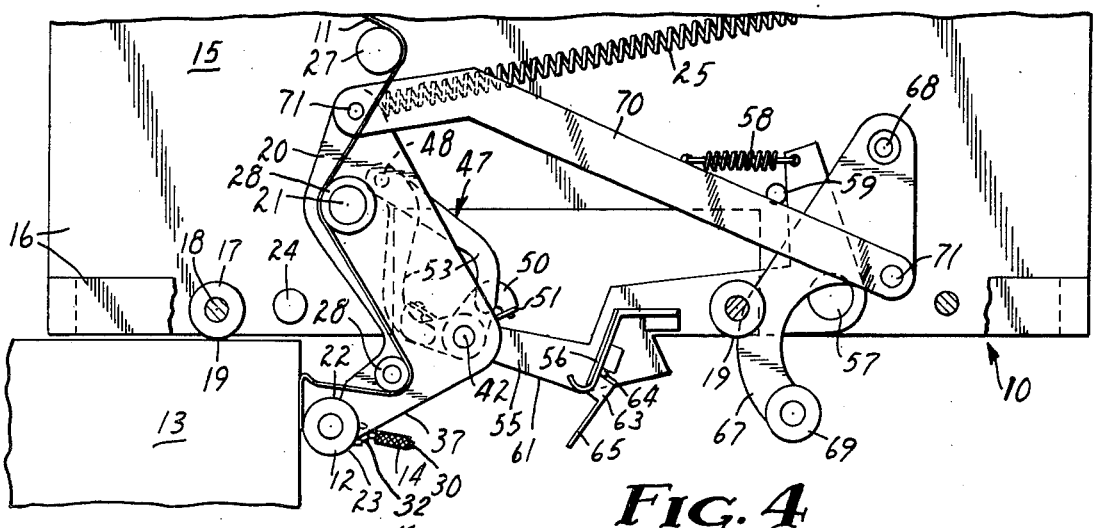
FIGS. 4 through 7 are side views of the device shown in FIG. 1 which, with FIG. 1, sequentially illustrate the application of a length of strip material to an object driven past the device, and show various parts of the device broken away to show details.
Figure 5:
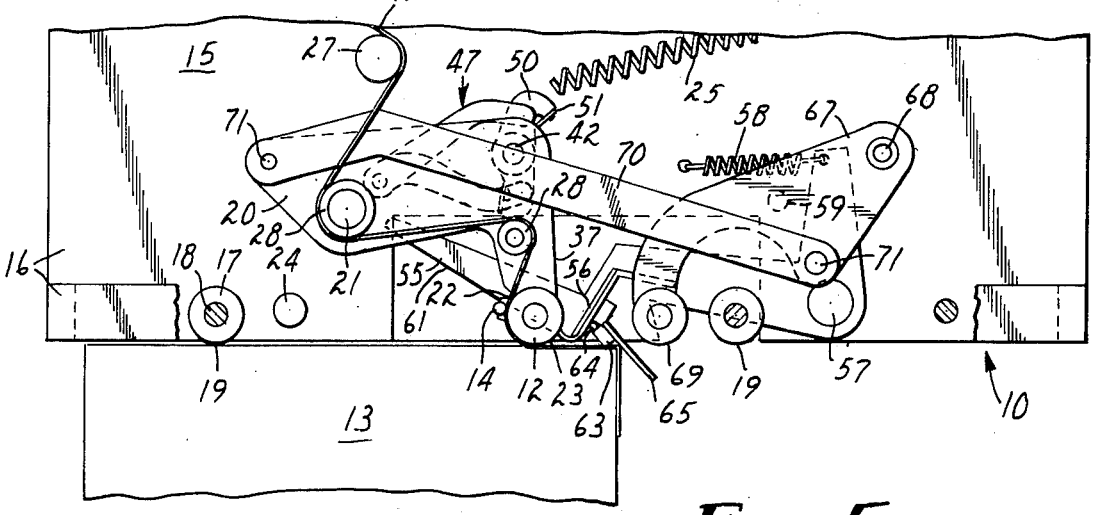
Figure 6:
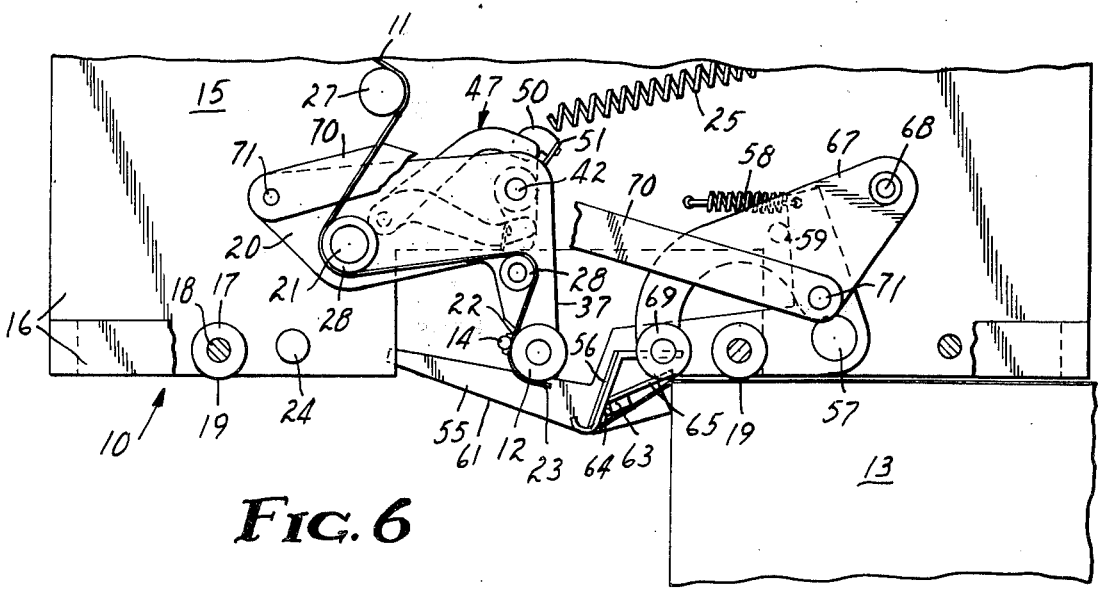

The device 10 includes an application member or roller 12, which, for each application cycle, is initially positioned in a contact position (FIG. 1) to support an end portion of the supply length of tape 11 for contact by a box 13 driven along the path. Means for mounting the application roller 12 affords movement thereof from the contact position (FIG. 1) after a predetermined force is applied against the tape thereon by the box 13 to insure adhesion between the tape and the box 13, and affords movement of the application roller 12 along the periphery of the box 13 (FIGS. 4 and 5) to a second position of the application roller 12 (FIG. 5) along the tape 11 being pulled from the supply length of tape 11 to press the tape 11 against the box 13. Severing means activated by movement of the box 13 past a predetermined position along the path is provided to sever an applied length of tape from the supply length 11 between the box 13 and the application roller 12 after the box 13 is driven past the contact roller 12 (FIG. 6), after which means on the device move the application roller 12 back to its contact position.

A pinch roller 14, providing means adapted for movable engagement with the adhesive surface of tape 11 supported on the application roller 12 is manipulated by means including cam and ratchet mechanisms operated by movement of the application roller 12 between its contact and second positions to (1) hold an end of the supply length of tape against the application roller 12 at a position closely adjacent its terminal end prior to contact between a box 13 driven along the path and the tape on the application roller 12 (FIG. 1); (2) move around a longitudinal edge of the tape being fed to the application roller 12 and re-engage the tape in advance of the portion of the contact roller 12 adjacent the box as the application roller moves to its second position (FIGS. 4 and 5); and (3) move from that position along the periphery of the application roller to engage the tape closely adjacent its new end and secure it to the application roller 12 as the application roller returns from its second to its contact position (FIG. 1).

The device 10 has a frame 15 including two parallel rectangular plates 16 which support the movable portions of the device 10. The two plates 16 have parallel edges which, together with a pair of rollers 17 rotatably mounted on shafts 18 between the plates 16, help define the path for the boxes along one side 19 of the device 10. A support member 20 is mounted on a shaft 21 fixed to the frame 15 for rotational movement about an axis transverse to the path of the boxes past the device 10 and parallel to the axis of the application roller 12. The support member 20 rotatably supports the application roller 12 so that its cylindrical periphery defines an arcuate or semi-circular route for the tape 11 with respect to the support member 20; the tape route extending from a start position 22 to an end position 23. Rotational movement of the support member 20 on the shaft 21 affords revolution of the application roller 12 between (1) its contact position defined by engagement between the support member 20 and a stop 24 on the frame 15 with the support member 20 projecting from the side 19 of the frame 15 and supporting the application roller 12 in the path with the peripheral surface portion thereof along the route positioned for contact by a box 13 driven along the path (FIG. 1); and (2) a second position with the peripheral surface of the application roller 12 positioned to contact the surface of a box 13 contacting the side 19 of the device 10. A spring 25 coupled between the support member 20 and the frame 15 biases the support member 20 to move the contact roller 12 to its contact position. The force to rotate the support member 20 and revolve the contact roller 12 to its second position against the bias of the spring 25 is provided by the means for driving a box 13 along the path via contact between the box 13 and the contact roller 12 through the tape 11 being applied to the box 13, and the spring 25 provides means for returning the application roller 12 from its second position to its contact position subsequent to the operation of the severing means, as will later be explained.

In its contact position a line between the application roller 12 and the shaft 21 forms with the side 19 an acute included angle opening toward an approaching box 13 so that during the initial movement of the application roller 12 toward the second position it will move away from the side 19, pull the end of the tape from under the pinch roller 14, and press it against the leading surface of the box 13, after which the application roller 12 will move toward the side 19 along the tape adhered to the box, with a portion of its periphery between the start position 22 and end position 23 positioned adjacent the box 13.

Means are provided for supporting the supply length of tape 11, and for guiding an end thereof to the periphery of the application roller 12 at the start position 22 and along the tape route from the start position 22 toward the end position 23 with the adhesive coating disposed away from the periphery of the application roller 12. A hub 26 is rotatably mounted on the frame 15 and is adapted for frictionally engaging a core in a supply roll of tape 11. From the supply roll, the tape 11 extends around a brake roller 27 rotatably mounted on the frame 15 which contacts the adhesive coating of the tape 11 and is adjustably frictionally braked via a friction clutch. Brakings force transferred by adhesive contact between the tape and the brake roller 27 will provide a predetermined tension in the length of the tape 11 extending beyond the brake roller 27. From the brake roller 27 the tape 11 extends around a pair of guide rollers 28 rotatably mounted on the support member 20, onto the periphery of the application roller 12 at the start position 22 and along the semi-circular route defined by the periphery of the application roller 12 relative to the support member 20.

The means adapted for movable engagement with the adhesive surface of the tape 11 on the application roller 12 comprises the pinch roller 14 which is deeply knurled about its periphery to afford rolling movement of the pinch roller 14 along the adhesive on the tape without excessive adhesion therebetween. The pinch roller 14 is rotatably mounted on a shaft 30 forming a portion of a pivot frame 32. The pivot frame 32 is mounted at a shaft 33 on a collar 34 rotatably mounted on the support member 20 for rotation coaxially with the application roller 12, the axis of the shaft 33 being generally normal to the axis of the pinch roller 14 and spaced from one end thereof. The pivot frame 32 is pivotal about the shaft 33 between (1) an engage position to which the pivot frame 32 is biased by a coil spring 35 coupled between the collar 34 and the pivot frame 32 with the axis of the pinch roller 14 generally parallel to the axis of the application roller 12, and the peripheral surfaces of the rollers 12 and 14 proximate so that the knurled surface of the pinch roller 14 is biased by the spring 35 against the pressure sensitive adhesive on tape positioned adhesive side out on the periphery of the application roller 12 to hold the tape in position, while affording longitudinal movement of the tape between the rotatable application and pinch rollers 12 and 14 (see the pivot frame 32 in FIG. 1); and (2) a release position with the pinch roller 14 separated from and spaced axially from one end of the periphery of the application roller 12 (see the pivot frame 32 in FIG. 4).

The cam mechanism provides means for moving the pinch roller 14 around a longitudinal edge of the tape 11 being fed to the application roller during rotational movement of the collar 34 relative to the support member 20 to move the pinch roller 14 along a first path portion from the end position 23 to the start position 22.

The cam mechanism includes a cam roller 36 rotatably mounted on the shaft 30 rotatably supporting the pinch roller 14 and at the end thereof adjacent the pivot shaft 33. The cam roller 36 is adapted to engage a cam edge surface 37 on the support member 20 and move the pivot frame 32 to its release position when the collar 34 is rotated to move the pinch roller 14 and cam roller 36 from the end position 23 into engagement with the support member 20. The thickness of the support member 20 adjacent the pinch roller 14 is adapted so that upon continued rotation of the collar 34, the pinch roller 14 will roll along the surface of the support member 20 opposite the application roller 12 around the longitudinal edge of the tape 11 with the axis of the pinch roller 14 generally at a right angle to the axis of the application roller 12, and the width of the support member 20 is adapted so that the pinch roller 14 and cam roller 36 will lose contact with the support member 20 and the spring 35 will return the pinch roller 14 to its engage position along the route and adjacent the start position 22.

The ratchet mechanism rotates the collar 34 to move the pinch roller 14 along the first path portion upon pivotal movement of the support member 20 to move the contact roller 12 from its contact position to its second position, and for rotating the collar to revolve the pinch roller 14 along a second path portion from adjacent the start position to the end position along the semi-circular route, with the pinch roller 14 in rolling engagement along tape 11 on the semi-circular route.

The ratchet mechanism includes a sprocket 40 fixed to the collar 34 and driven by a sprocket 41 rotatably mounted on a shaft 42 through a roller chain 43. A projecting hub on the sprocket 41 has four notches to provide a four toothed ratchet wheel 46. Two pawl arm assemblies 47 are coupled between the ratchet wheel 46 and a pivot shaft 48 fixed to the frame 15. Each pawl arm assembly 47 includes a guide member 50 pivotably mounted on the shaft 42 and supporting a spring 51 having a cantilevered end adapted to engage the notches and afford driving engagement between the guide member 50 and the ratchet wheel 46 in the proper direction for driving the pivot frame 32 carried on the collar 34 along the first and second path portions, and to deflect to afford rotation of the guide member 50 around the ratchet wheel 46 in the opposite direction. Each pawl arm assembly also includes a drive lever 53 pivotably coupled between the pivot shaft 48 and a pivot pin 54 on its guide member 50. With the application roller 12 in the contact position, the pivot pins 54 on the guide members 50 are disposed on opposite sides of a line joining the center of the pivot shaft 48 and the shaft 42, and on the side of the ratchet wheel 46 adjacent the pivot shaft 48. The pivot shaft 48 is disposed on the side of the shaft 21 about which the support member 20 rotates and on its side away from the application roller 12 so that as the support member 20 rotates to revolve the application roller 12 from its contact position to its second position, the distance between the shaft 42 supporting the sprocket 41 on the support member 20 and the pivot shaft 48 on the frame 15 will decrease, causing the guide members 50 to rotate in opposite directions around the shaft 42, so that the spring 51 on the guide member 50 adjacent the roller 12 will engage the teeth on the ratchet wheel 46, rotating it, and thereby the pinch roller 14 from the end position 23 to the start position 22 along the first path portion to operate the cam mechanism. The spring 51 on the pawl assembly 47 opposite the application roller 12 slips along the teeth during such movement, however upon return movement of the application roller 12 from its second to its contact position, that spring 51 engages the teeth in the ratchet wheel 46 (while the spring on the other pawl arm assembly 47 slips), and drives the collar 34 in the same direction as it was driven during movement of the application roller 12 from its contact to its second position to move the contact roller along the second path portion and roll the pinch roller 14 along tape 11 on the periphery of the application roller 12 from adjacent the start position 22 to the end position 23.

The means for severing the applied length of tape from the supply length of tape 11 includes a bar 55 supporting a knife blade 56 and mounted for pivotal motion about a shaft 57. The bar 55 is biased by a spring 58 toward a severed position (FIGS. 1, 4 and 6) with a portion of the bar 55 against a rubber stop 59 fixed to the frame 15, and with a sharp serrated edge on the knife blade 56 and a contact edge 61 along a stepped end portion of the bar 55 projecting past the side 19 of the frame 15 into the path for boxes driven past the device 10. The portion of the contact edge 61 first engaged by a box 13 forms an acute angle with the side 19 so that contact therewith by a box driven along the path will cam the bar 55 against the bias of the spring 58 to a set position at which the edge of the knife blade 56 is between the plates 16 and spaced from the side 19.

After the trailing edge of the box 13 moves past the application roller 12, the application roller 12 is temporarily retained in its second position by means to be explained later, while the tape 11 is tensioned between the trailing edge of the box 13 and the application roller 12 along the side 19 of the frame 15. As the trailing edge of the box moves out of engagement with the contact edge 61 on the stepped end portion of the bar 55 the spring snaps the bar 55 to its severed position in contact with the stop 59 so that the blade 56 passes through and severs the tensioned tape 11 (FIG. 6), the end of the contact edge 61 and positioning of the knife being adapted to provide a trailing end on the applied length of tape sufficient to extend a predetermined distance down the trailing surface of the box; leaving the newly severed end of the tape supply 11 between the application roller 12 and the pinch roller 14 (which is adjacent the start position 22) to support the newly severed end of the tape out of contact with the box 13.

The severing means also includes a knife guard 63 mounted at a pin 64 on the bar 55 for pivotal movement from a safe position enclosing the edge of the knife blade 56, and an unguarded position spaced from the knife blade 56, and having fingers 65 extending beyond the edge of the knife blade 56 into the path and of sufficient length for engagement by a box moving therealong to pivot the knife guard 63 to the unguarded position to afford severing of the tape 11 as the box leaves the contact edge 61.

Means are provided for pressing an applied length of tape against a box 13 driven along the path, including the support member 20 and the application roller 12 which are biased by the spring 25 into engagement with the leading surface and the surface along the side 19 of a box moving along the path. Also included is an arm 67 pivotably mounted at one end on a shaft 68 fixed to the frame 15 and rotatably supporting a buffing roller 69 at its opposite end.

The arm 67 is pivotal between a retracted position with the buffing roller 69 between the plates 16, spaced from the side 19 of the frame 15, and spaced along the path in the direction of travel of a box therealong from the application roller 12 and knife blade 56; and a normal position projecting from the edge 19 into the box path, the buffing roller 69 being supported on an arcuate portion of the arm 67 to afford contact between the buffing roller 69 and the trailing surface of a box 13 during movement of the arm 67 from the retracted to the normal position.

Figure 7:
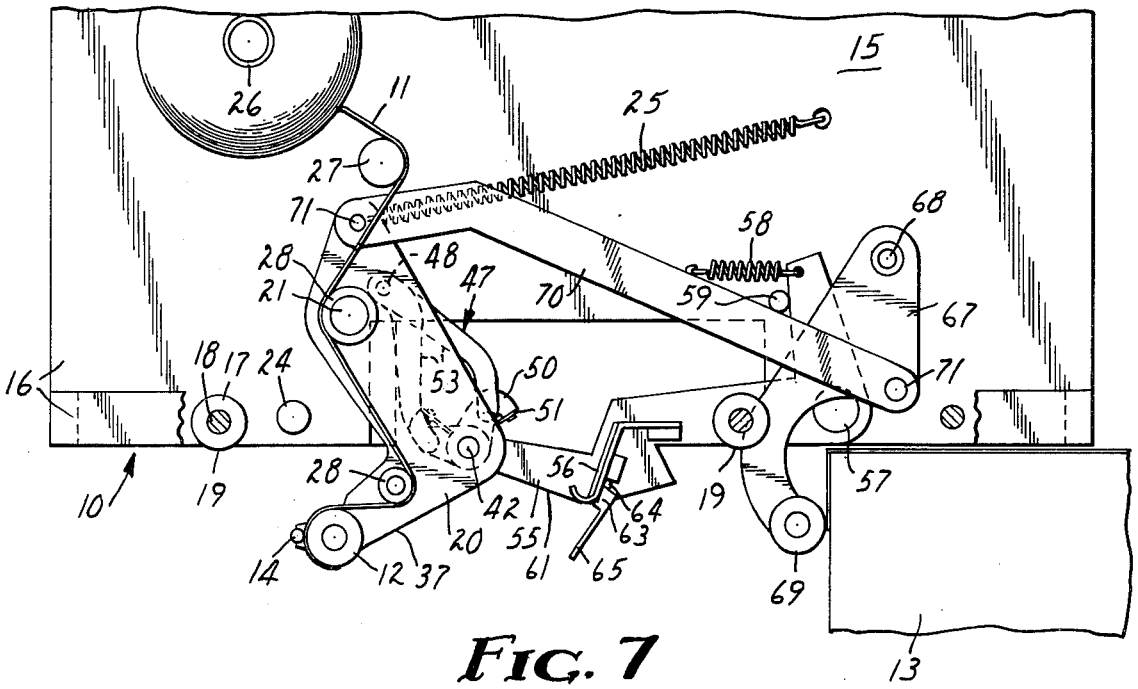
Figure 8:
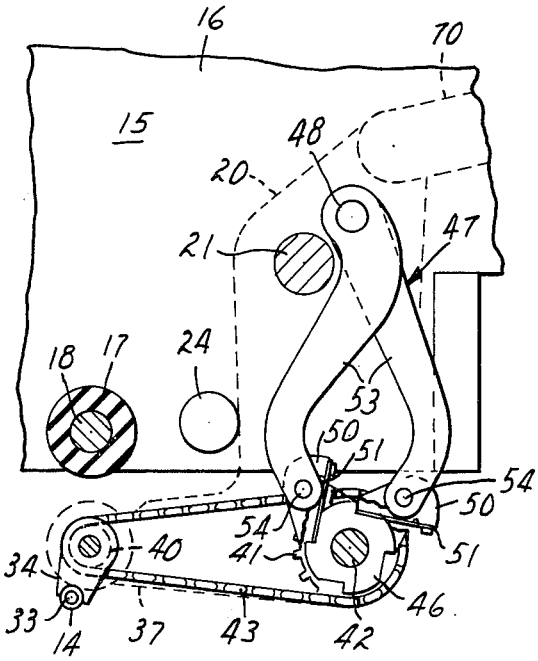
FIGS. 8 and 9 are fragmentary enlarged side views of a ratchet mechanism in the device shown in FIG. 1.
Figure 9:
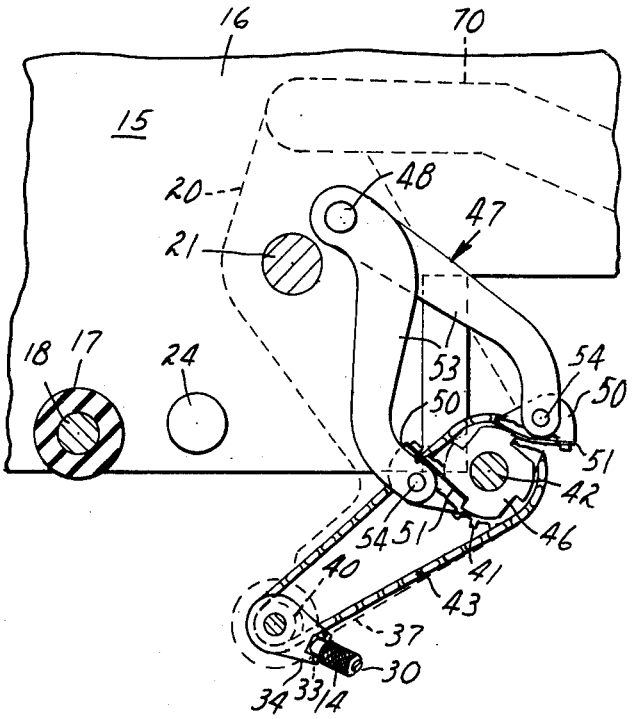

A link 70 is pivotably mounted at pins 71 between the support member 20 and the arm 67, and provides means for (1) moving the arm 67 from its normal to its retracted position upon movement of the application roller 12 from its contact to its second position along the periphery of a box 13, (2) for temporarily maintaining the application roller in its second position via the arm 67 and buffing roller 69 after the trailing edge of the box moves past the application roller 12, and (3) for transferring the force of the spring 25 to bias the buffing roller 69 against a box 13 driven along the path after the box 13 moves out of contact with the application roller 12 so that the buffing roller 69 will move along the surface of the box along the side 19 of the frame 15 and the trailing surface of the box 13 and press the severed end of an applied length of tape along the trailing surface while the application roller 12 and the buffing roller 69 return to their contact and normal positions under the influence of the spring 25 (FIG. 7).

OPERATION

The operation of the device 10 to apply a length of tape 11 to a box 13 driven along the path will now be explained. Initially the application roller 12 is in its contact position (FIG. 1). An end of the supply length of tape 11 from the roll extends around the brake and guide rollers 27 and 28, onto the periphery of the application roller 12 at the start position 22, and around the application roller 12 along the semi-circular tape route defined thereby, with a terminal end portion of the tape 11 being positioned between the application roller 12 and pinch roller 14 at the end position 23. The tape 11 is positioned with its adhesive surface away from the application roller 12, so that as the box 13 is driven along the path its leading surface will contact and adhere to the tape on the application roller 12, causing the support member 20 to rotate about the shaft 21 after sufficient pressure is applied to overcome the spring 25 and insure such adhesion. As the support member 20 first begins to rotate, the tape 11 will be pulled from the roll and the application roller 12 will roll along the front surface of the box away from the side 19 pulling the end of the tape from between the pinch and application rollers 14 and 12, and smoothing it against the leading surface of the box 13. After the leading surface of the box passes the shaft 21 the contact roller 12 will roll along the tape 11 applied on the leading surface of the box 13 toward the side 19 to its second position, and then along tape applied on the surface of the box 13 contacting the side 19, pressing the tape into engagement with the box 13 under the influence of the spring 25.

Revolution of the application roller to its second position causes the spring 51 on the pawl arm assembly 47 adjacent the application roller 12 to engage and rotate the ratchet wheel 46 as the distance between the pivot shaft 48 and shaft 42 decreases, thereby rotating the collar 34 via the sprockets 40 and 41 and 43 to move the cam roller 36 into engagement with the cam edge 37 on the support member 20 and cam the pivot frame 32 carrying the pinch roller 14 to its release position, and move the pinch roller 14 across the surface of the support member 20 opposite the application roller 12 around the longitudinal edge of the tape 11 being guided around the application roller 12 until the cam roller 36 loses contact with the support member 20 and the spring 35 returns the pivot frame 32 to its engage position with the pinch roller 14 in engagement with the tape 11 adjacent the start position 22.

During such movement of the support member 20 and collar 34 the leading surface of the box contacts the contact edge 61 of the bar 55 and pivots it against the bias of the spring 58 causing the knife blade 56 thereon to move to its set position spaced from the tape 11 being applied on the surface of the box 13 along the side 19, and contacts the fingers 65 to pivot the knife guard 63 to its unguarded position spaced from the knife 56. Next the box 13 moves adjacent the buffing roller 69 which has been moved to its retracted position during revolution of the application roller 12 via the support member 20, link 70 and arm 67. Subsequently as the trailing edge of the box moves past the application roller 12, the application roller will be retained in its second position via the link 70 by contact between the buffing roller 69 and the tape applied on the surface of the box along the side 19 so that a length of tape will be tensioned between the box and the application roller 12 along the side 19 and adjacent the knife blade 56. As the trailing edge of the box 13 moves from under the contact edge 61 of the bar 55, the spring 58, in moving the bar 55 to the stop 59 snaps the knife blade 56 through that tensioned length of tape 11. Further movement of the box 13 allows the buffing roller 69 on the arm 67 to move down the trailing surface of the box 13 and press the tape into engagement therewith under the influence of the spring 25 with the rotation of the arm 67 so caused allowing movement of the support member 20 to again position the application roller 12 in its contact position.

As the support member 20 is thus pivoted to the contact position of the application roller 12, the spring 51 on the pawl arm assembly 47 most distant from the ratchet wheel 46 engages and rotates the ratchet wheel 46 as the distance between the pivot shaft 48 and shaft 42 increases, thereby rotating the collar 34 to revolve the pinch roller 14 around the application roller 12 in contact with the newly severed end portion of the tape thereon from adjacent the start position 22 to the end position to secure the newly severed end of the tape supply against the application roller. The device 10 is then ready to apply a strip to the next box moving along the path.

I claim:

1. A device adapted for applying lengths of pressure sensitive adhesive coated tape from a supply length of tape seriatim on the surfaces of spaced rectangular objects driven along a predetermined path in a first direction past the device, said device comprising:

a frame;

an application member having a arcuate periphery defining an arcuate tape route extending adjacent one edge of said periphery from a start position to an end position;

means on said frame adapted for guiding a said supply length of tape to said periphery at said start position and along said tape route with the adhesive coating disposed away from said application member;

means mounting said application member on said frame to afford movement thereof from a contact position with said tape route in said path to afford contact between an end portion of a said supply length of tape disposed along said tape route and a said object driven along said path in said first direction to adhere the end portion of the supply length of tape to the object, to a second position to afford movement of the periphery of said application member along the length of tape being applied to the object;

means mounted on said frame and adapted to be activated by movement of a said object past a predetermined position along said path for severing an applied length of tape from said supply length of tape between said application member and the object subsequent to movement of the object past said application member;

means for moving said application member from said second position to said contact position subsequent to the activation of said severing means;

engagement means adapted for engagement with the adhesive surface of a said tape while affording longitudinal movement of the tape relative thereto;

means mounting said engagement means for movement on a first path portion from a first engage position at the end position along said arcuate tape route to afford engagement of said engagement means with the end of a said supply length of tape on said arcuate tape route at said end position, away from said arcuate tape route to a release position at which said engagement means is spaced from said one edge of said arcuate periphery, from said release position to a second engage position adjacent said start position along said arcuate tape route to afford engagement with tape on said arcuate tape route adjacent said start position with the part of said first path portion for said engagement means from said release position to said second engage position being adapted to afford movement of said engagement means around the longitudinal edge of a said supply length of tape guided onto said arcuate periphery at said start position; and on a second path portion from said second engage position to said first engage position along said arcuate tape route with said engagement means positioned to afford movement along the adhesive surface of tape disposed along said arcuate tape route; and means coupled to said means mounting said engagement means and operated by movement of said application member relative to said frame for moving said engagement means along said first path portion upon movement of said application member from said contact to said second position, and for moving said engagement means along said second path portion upon movement of said application member from said second to said contact position.

2. A device according to claim 1, wherein said arcuate periphery has an axis;

said means adapted for movable engagement with the adhesive surface of a said tape comprises:

a pinch roller having an axis and a peripheral surface adapted to contact the adhesive surface of said tape; and a pivot frame rotatably supporting said pinch roller;

said means mounting said engagement means comprises:

a collar mounted adjacent said one edge of said arcuate periphery for rotation relative to said arcuate tape route about the axis of said arcuate periphery, said collar supporting said pivot frame for pivotal movement about an axis generally normal to the axis of said pinch roller and spaced from one end thereof between said release position at which the axis of said pinch roller is generally at a right angle to the axis of said arcuate periphery and said frame and pinch roller are spaced from said one edge of said arcuate periphery, and said engaged positions at which the axes of said pinch roller and said arcuate periphery are generally parallel and the peripheral surface of said pinch roller is positioned to afford contact with the adhesive surface of tape along said arcuate tape route;

means for biasing said pivot frame toward said engaged positions; and cam means for pivoting said pivot frame against the influence of said biasing means to move said pivot frame and pinch roller from said first engage position to said release position and to subsequently afford movement thereof from said release position to said second engage position under the influence of said biasing means during movement of said pinch roller and pivot frame along said first path portion; and said means coupled to said means mounting said engagement means is adapted to rotate said collar in only one direction and for a complete revolution relative to said arcuate periphery during movement of said application member from said contact to said second position and back to said contact position to correspondingly move said pivot frame and pinch roller along said first and second path portions.

3. A device according to claim 2, further including a support member supporting said application member and mounted for pivotal movement in a first direction to afford movement of said application member from said contact to said second position, and in a second opposite direction to afford movement of said application member from said second to said contact position; and said means coupled to said means mounting said engagement means and operated by movement of said application member comprises:

a ratchet mechanism including a toothed ratchet wheel rotatably mounted on said support member;

first and second pawl arm assemblies each having one end pivotably mounted on said frame and a second end adapted for engagement with teeth in said ratchet wheel to drive said ratchet wheel in a first direction of rotation, the second end of said first pawl arm assembly being positioned along one side of said ratchet wheel to rotate said ratchet wheel in said first direction upon pivotal movement of said support member to move said application member from said contact position to said second position, and the second end of said second pawl arm assembly being positioned along the side of said ratchet wheel opposite said one side to rotate said ratchet wheel in said first direction upon return motion of said support member to the contact position of said application roller; and means for providing driving engagement between said ratchet wheel and said collar.

4. A device according to claim 1, wherein said device further includes:

means for biasing said application member toward said contact position;

a buffing roller;

an arm supporting said buffing roller for rotation about an axis parallel to the arcuate periphery of said application member and pivotably mounted on said frame for rotation about an axis parallel to that of said buffing roller between a retracted position with said application roller spaced from said path and spaced along said path in said first direction from said severing means, and a normal position projecting from said frame into said path with said roller positioned to contact a said length of tape applied on a said object upon movement of said arm from said retracted to said normal position; and means coupled between said arm and said application member for moving said buffing roller from said normal to said retracted position upon movement of said application member from said contact position to said second position, and for biasing said buffing roller against the object under the influence of said biasing means after said object moves out of contact with said application member to provide movement of said buffing roller along tape applied to the trailing surface of the object upon return movement thereof to said normal position.

5. A device adapted for applying lengths of pressure sensitive adhesive coated tape from a supply length of tape seriatim on the surfaces of spaced objects driven along a predetermined path in a first direction past the device, said device comprising:

a frame;

an application roller having a cylindrical periphery;

a support member supporting said application roller to define an arcuate tape route from a start position to an end position relative to said support member, said support member being mounted on said frame for pivotal movement about an axis transverse to said path and parallel to and spaced from the axis of said application roller to afford revolution of said application roller from a contact position with the portion of said periphery along said arcuate tape route disposed to afford contact of an end portion of a said supply length of tape thereon by an object driven along said path in said first direction, in a first direction of rotation to a second position to afford movement of the application roller along a length of tape being applied to the periphery of the object with the portion of said periphery along said arcuate tape route adjacent the object;

means on said frame adapted for supporting a said supply length of tape and for guiding an end thereof to the periphery at said start position and along said tape route with the adhesive coating of the tape disposed away from said application roller;

means mounted on said frame and adapted to be activated by movement of a said object past a predetermined position along said path for severing an applied length of tape from a said supply length of tape between said application roller and the object subsequent to movement of the object past said application roller;

means for biasing the support member to revolve the application roller back to the application position subsequent to operation of said tape severing means;

a pinch roller having an axis;

a pivot frame supporting said pinch roller for rotation about the axis of the pinch roller;

a collar mounted on said support member adjacent one end of said application roller for independent rotation about the axis of said application roller and supporting said pivot frame for pivotal movement about an axis generally normal to the axis of said pinch roller and spaced from one end thereof between an engage position of said pinch roller with the axes of the pinch roller and application roller generally parallel amd with the peripheral surfaces of the rollers proximate to engage opposite surfaces of said tape positioned therebetween, and a release position of said pinch roller with the pinch roller spaced axially from one end of the periphery of said application roller;

means for biasing said pivot frame toward the engaged position of said pinch roller;

cam means adapted to move said pivot frame from said engage position to said release position and back to said engage position to afford movement of said pivot frame and pinch roller around the longitudinal edge of a said length of tape guided onto said application roller adjacent said start position upon rotation of said collar relative to said support member to move said pinch roller from said end position toward said start position along the peripheral portion of said application roller spaced from said arcuate tape route; and means for rotating said collar relative to said support member to move said pinch roller from said end position to said start position along the peripheral portion of said application roller spaced from said arcuate tape route upon pivotal movement of said support member to move said application roller from said contact position to said second position, and for rotating said collar to move said pinch roller along the peripheral surface of said application roller at said arcuate tape route from said start position to said end position upon subsequent movement of said support member back to said contact position.

6. A device accordng to claim 5, wherein said means for rotating said collar comprises:

a toothed rachet wheel rotatably mounted on said support member;

first and second pawl arm assemblies each having one end pivotably mounted on said frame and a second end adapted for engagement with teeth in said ratchet wheel to drive said ratchet wheel in a first direction of rotation, the second end of said first pawl arm assembly being positioned along one side of said rachet wheel to rotate said ratchet wheel in said first direction upon pivotal movement of said support member to move said application roller from said contact position to said second position, and the second end of said second pawl arm assembly being positioned along the side of said ratchet wheel opposite said one side to rotate said ratchet wheel in said first direction upon return motion of said support member to the contact position of said application roller; and means for providing driving engagement between said ratchet wheel and said collar.

7. A device according to claim 5, wherein said device further includes:

a buffing roller;

an arm supporting said buffing roller for rotation about an axis parallel to the axis of said application roller and pivotably mounted on said frame for rotation about an axis parallel to that of said buffing roller between a retracted position with said application roller spaced from said path and spaced along said path in said first direction from said severing means, and a normal position projecting from said frame into said path with said roller positioned to contact a said length of tape applied on a said object upon movement of said arm from said retracted to said normal position; and means coupled between said arm and said support member for moving said buffing roller from said normal to said retracted position upon movement of said application roller from said contact poisition to said second position, and for biasing said buffing roller against the object under the influence of said biasing means after said object moves out of contact with said application roller to provide movement of said buffing roller along tape applied to the trailing surface of the object upon return movement thereof to said normal position.

8. A device adapted for applying lengths of pressure sensitive adhesive coated tape from a supply length of tape seriatim on the surfaces of spaced rectangular objects driven along a predetermined path in a first direction past the device, said device comprising:

a frame;

an application member having an arcuate periphery defining an arcuate tape route extending adjacent one edge of said periphery from a start position to an end position;

means on said frame adapted for guiding a said supply length of tape to said periphery at said start position and along said tape route with the adhesive coating disposed away from said application member;

means mounting said application member on said frame to afford movement thereof from a contact position with said tape route in said path to afford contact between an end position of a said supply length of tape disposed along said tape route and a said object driven along said path in said first direction to adhere the end portion of the supply length of tape to the object, to a second position to afford movement of the periphery of said application member along the length of tape being applied to the object;

means mounted on said frame and adapted to be activated by movement of a said object past a predetermined position along said path for severing an applied length of tape from said supply length of tape between said application member and the object subsequent to movement of the object past said application member;

means for moving said application member from said second position to said contact position subsequent to the activation of said severing means;

engagement means adapted for engagement with the adhesive surface of a said tape while affording longitudinal movement of the tape relative thereto;

means mounting said engagement means for movement on a first path portion from a first engage position at the end position along said arcuate tape route to afford engagement of said engagement means with the end of a said supply length of tape on said arcuate tape route at said end position, away from said arcuate tape route to a spaced position at which said engagement means is spaced from said one edge of said arcuate periphery, from said spaced position to a second engage position adjacent said start position along said arcuate tape route to afford engagement with tape on said arcuate tape route adjacent said start position with the part of said first path portion for said engagement means from said spaced position to said second engage position being adapted to afford mmovement of said engagement means around the longitudinal edge of a said supply length of tape guided onto said arcuate periphery at said start position; end on a second path portion from said second engage position to said first engage position along said arcuate tape route with said engagement means positioned to afford movement along the adhesive surface of tape disposed along said arcuate tape route; and means coupled to said means mounting said engagement means and adapted for operation by movement of a said object along said path for moving said engagement means along said first path portion prior to operation of said severing means and for moving said engagement means along said second path portion subsequent to operation of said severing means.

9. A device according to claim 8, wherein said means coupled to said means mounting said engagement means is operated by movement of said application member relative to said frame to move said engagement means along said first path portion during movement of said application member from said contact to said second position, and to move said engagement means along said second path portion during movement of said application member from said second to said contact position.

* * * * *